US006793432B1

(12) United States Patent
Kowalewski

(10) Patent No.: US 6,793,432 B1
(45) Date of Patent: Sep. 21, 2004

(54) TOOTHBRUSH AND TOOTHPASTE TUBE HOLDER COMBINATION

(76) Inventor: James S. Kowalewski, 11331 Bristerburg Rd., Catlett, VA (US) 20119

( * ) Notice: Subject to any disclaimer, the term of this patent is extended or adjusted under 35 U.S.C. 154(b) by 0 days.

(21) Appl. No.: 10/449,896

(22) Filed: Jun. 2, 2003

(51) Int. Cl.[7] ..... B43M 11/06; A46B 11/04
(52) U.S. Cl. ..... 401/183; 401/185; 401/270
(58) Field of Search ..... 401/183, 189, 401/185, 186, 268, 270, 282, 152, 156

(56) References Cited

U.S. PATENT DOCUMENTS 1,504,143 A * 8/1924 Roberts ..... 401/152
4,155,663 A * 5/1979 Cerquozzi ..... 401/135
5,028,158 A 7/1991 Fey
5,572,762 A 11/1996 Scheiner
5,846,010 A * 12/1998 Barbalich ..... 401/188
5,911,532 A 6/1999 Evancic
5,924,159 A 7/1999 Haitin
5,974,616 A 11/1999 Dreyfus

* cited by examiner

*Primary Examiner*—David J. Walczak

(57) ABSTRACT

A toothbrush and toothpaste tube holder combination includes a container including a first end wall, a second end wall and a peripheral comprising a resiliently elastic material. A threaded depression adapted for receiving a threaded male end of a toothpaste tube is positioned in an inner surface of the first end wall. An elongated and hollow shaft has a first end and a second end. The first end is attached to and outer surface of the first end wall and is fluidly coupled to the threaded depression. The shaft has plurality of openings therein positioned adjacent to the second end. The openings are fluidly coupled to the threaded depression. A plurality of bristles is attached to the shaft and extends away therefrom. The tube may be selectively coupled to the threaded depression such that pressure on the tube forces toothpaste therein through the shaft and outward through the openings.

5 Claims, 3 Drawing Sheets

TOOTHBRUSH AND TOOTHPASTE TUBE HOLDER COMBINATION

BACKGROUND OF THE INVENTION

1. Field of the Invention

The present invention relates to toothbrush and toothpaste combinations and more particularly pertains to a new toothbrush and toothpaste combination for holding a tube of toothpaste and delivering toothpaste to a toothbrush.

2. Description of the Prior Art

The use of toothbrush and toothpaste combinations is known in the prior art. While these devices fulfill their respective, particular objectives and requirements, the need remains for a device that contains a tube of toothpaste in such a manner as to make it easy to use while ensuring that toothpaste spillage does not occur.

SUMMARY OF THE INVENTION

The present invention meets the needs presented above by including a container comprising a first end wall, a second end wall and a peripheral. The peripheral wall comprises a resiliently elastic material. A threaded depression adapted for receiving a threaded male end of a toothpaste tube is positioned in an inner surface of the first end wall. An elongated and hollow shaft has a first end and a second end. The first end is attached to and outer surface of the first end wall and is fluidly coupled to the threaded depression. The shaft has plurality of openings therein positioned adjacent to the second end of the shaft. The openings are fluidly coupled to the threaded depression. A plurality of bristles is attached to the shaft and extends away therefrom. The bristles are disposed generally adjacent to the openings. Wherein the tube may be selectively fluidly coupled to the threaded depression such that pressure on the tube forces toothpaste therein through the shaft and outward through the openings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
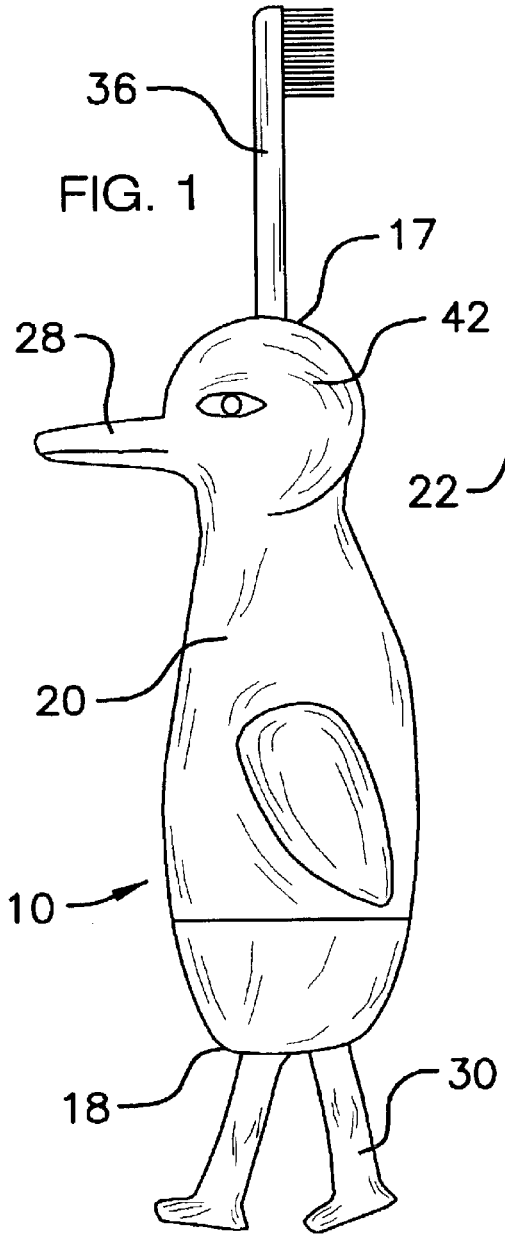
FIG. 1 is a schematic side view of a toothbrush and toothpaste tube holder combination according to the present invention.

With reference now to the drawings, and in particular to FIGS. 1 through 5 thereof, a new toothbrush and toothpaste combination embodying the principles and concepts of the present invention and generally designated by the reference numeral 10 will be described.

As best illustrated in FIGS. 1 through 5, the toothbrush and toothpaste tube holder combination 10 generally comprises a device for receiving a tube of toothpaste 12 having a threaded male end 14. The device comprises a container 16 including a first end wall 17, a second end wall 18 and a peripheral wall 20. The peripheral wall 20 comprises a resiliently elastic material such as a plastic or elastomeric material. The peripheral wall 20 has an aperture 22 extending therethrough and into an interior of the container 16. A threaded depression 24 adapted for receiving the threaded male 14 end is positioned in an inner surface 26 of the first end wall 17. The container 16 preferably has a shape of a bird. The bird includes a beak 28. The aperture 22 extends into a free end of the beak 28. A pair of legs 30, having feet thereon, is attached to and extends away from the second end wall 18. The container 16 has a break therein such that a first portion 32 and a second portion 34 of the container 16 are defined. The first portion 32 is selectively couplable to the second portion 34 by frictional coupling, through a screw type coupling system may also be employed.

An elongated and hollow shaft 36 has a first end 38 and a second end 40. The first end 38 is attached to an outer surface 42 of the first end wall 17 and is fluidly coupled to the threaded depression 24. The shaft 36 has plurality of openings 44 therein positioned adjacent to the second end 40 of the shaft 36. The openings 44 are fluidly coupled to the threaded depression 24. A plurality of bristles 46 is attached to the shaft 36 and extends away therefrom. The bristles 46 are disposed generally adjacent to the openings 44. The shaft 36 and bristles 46 form the outer appearance of a conventional toothbrush and function as such.

Figure 2:
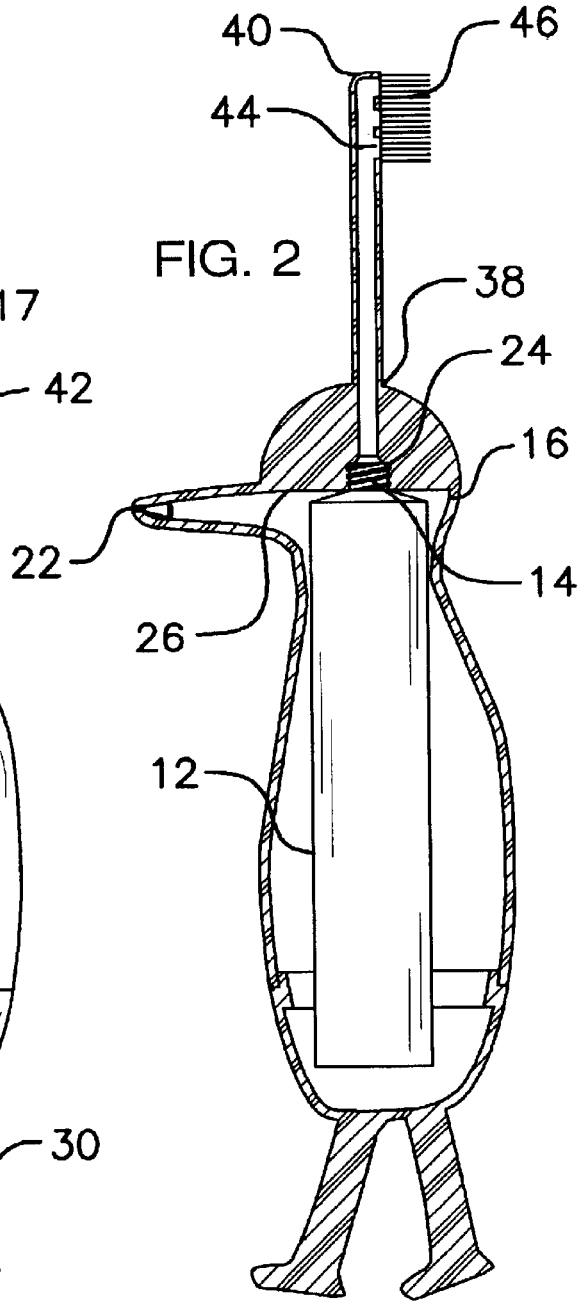
FIG. 2 is a schematic side cross-sectional view of the present invention.
Figure 3:
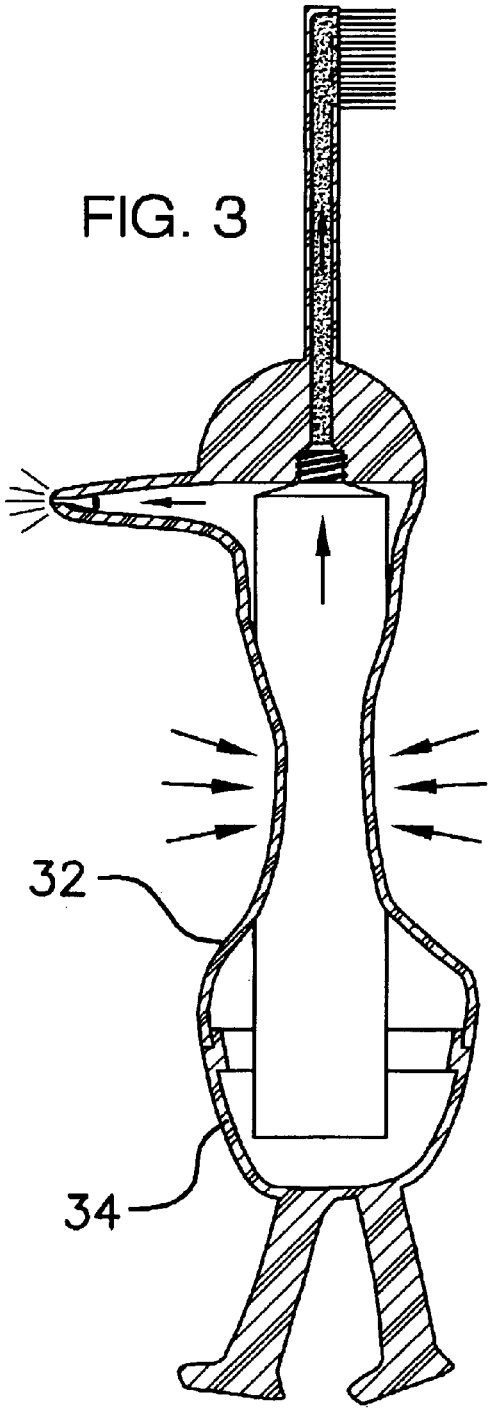
FIG. 3 is a schematic side cross-sectional view of the present invention.

In use, the tube 12 may be selectively fluidly coupled to the threaded depression 24 as shown in FIG. 2. Pressure may be placed on the peripheral wall 20 as depicted in FIG. 3 such that the tube of toothpaste 12 is squeezed. This forces toothpaste in the tube 12 to travel through the shaft 36 and outward through the openings 44. This places the toothpaste on the bristles 46. Because the tube 12 is contained within the container, there is little opportunity for spillage of the toothpaste so that the device 10 is easy to use for children.

Figure 4:
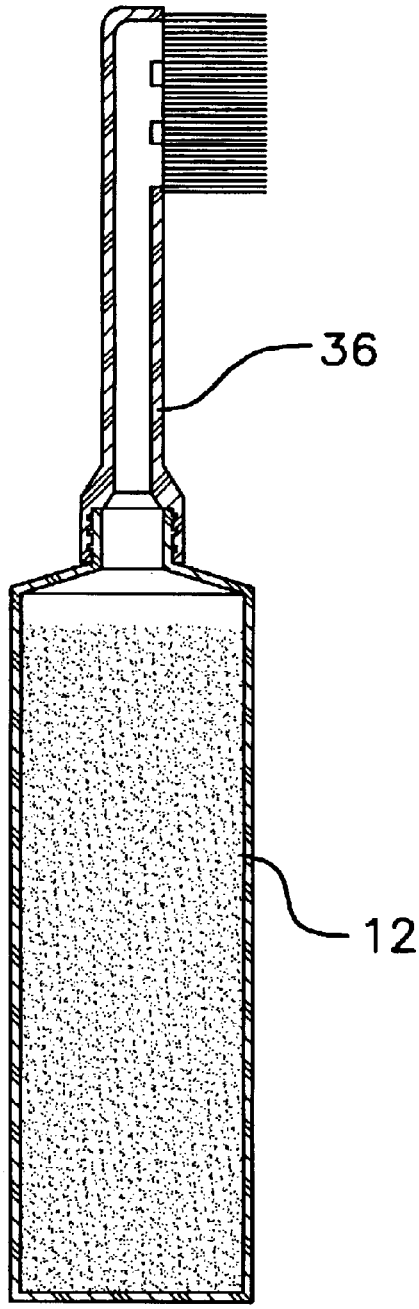
FIG. 4 is a schematic cross-sectional view of a second embodiment of the present invention.
Figure 5:
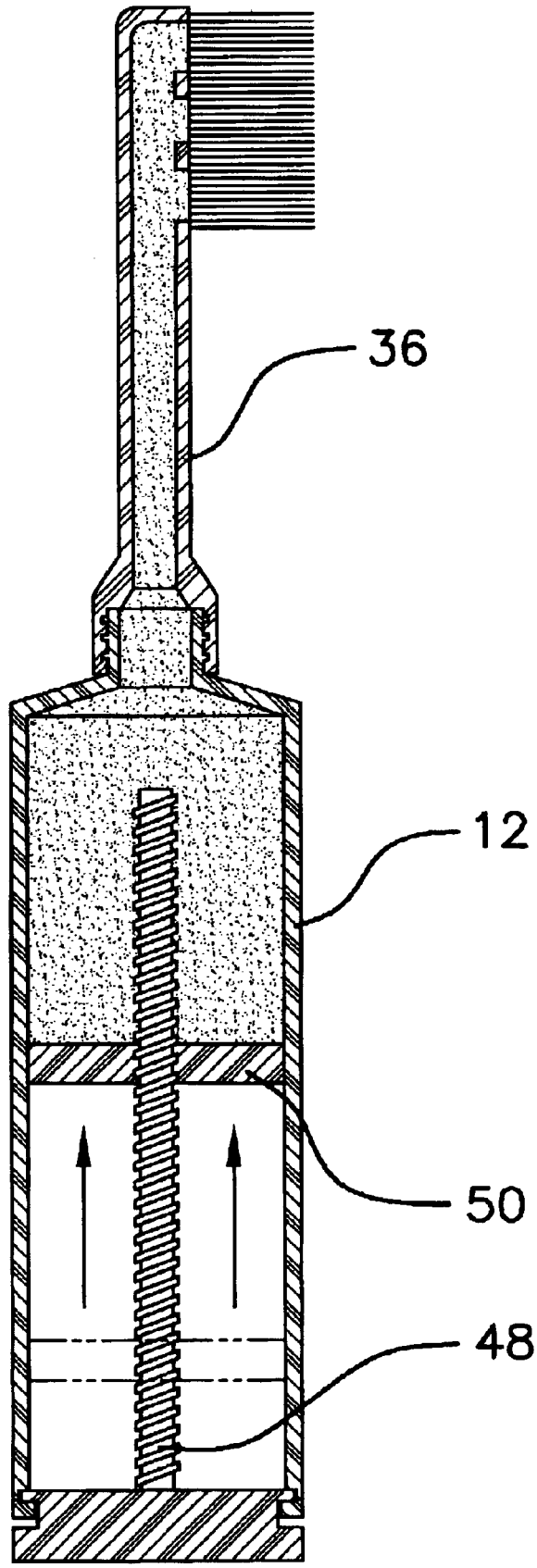
FIG. 5 is a schematic cross-sectional view of third embodiment of the present invention.

Alternate embodiments of the device are shown in FIGS. 4 and 5. In both cases, the shaft 36 is attached directly to the threaded male end 14 of the tube 12 such that toothpaste therein may be forced to travel outwardly through the shaft 36. FIG. 5 utilizes a rotatable rod 48 threadably coupled to a disc 50 for forcing the toothpaste outwards through the shaft 36.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothbrush holder and toothpaste tube receiver combination device for receiving a tube of toothpaste having a threaded male end, said device comprising:

a container including a first end wall, a second end wall and a peripheral wall, said peripheral wall comprising a resiliently elastic material, a threaded depression adapted for receiving said threaded male end being positioned in an inner surface of said first end wall, said container having a shape of a bird, said bird including a beak, an aperture extending into a free end of said beak and into an interior of said container;

an elongated and hollow shaft having a first end and a second end, said first end being attached to an outer surface of said first end wall and being fluidly coupled to said threaded depression, said shaft having plurality of openings therein positioned adjacent to said second end of said shaft, said openings being fluidly coupled to said threaded depression, a plurality of bristles being attached to said shaft and extending away therefrom, said bristles being disposed generally adjacent to said openings; and wherein the tube may be selectively fluidly coupled to said threaded depression such that pressure on the tube forces toothpaste therein through said shaft and outward through said openings.

2. The toothbrush holder of claim 1, wherein said peripheral wall includes an aperture extending therethrough and into an interior of said container.

3. The toothbrush holder of claim 1, further including a pair of legs being attached to and extending away from said second end wall.

4. The toothbrush holder of claim 1, wherein said container has a break therein such that a first portion and a second portion of said container are defined, said first portion being selectively couplable to said second portion.

5. A toothbrush holder and toothpaste tube receiver combination device for receiving a tube of toothpaste having a threaded male end, said device comprising:

a container including a first end wall, a second end wall and a peripheral wall, said peripheral wall comprising a resiliently elastic material, said peripheral wall having an aperture extending therethrough and into an interior of said container, a threaded depression adapted for receiving said threaded male end being positioned in an inner surface of said first end wall, said container having a shape of a bird, said bird including a beak, said aperture extending into a free end of said beak, a pair of legs being attached to and extending away from said second end wall, said container having a break therein such that a first portion and a second portion of said container are defined, said first portion being selectively couplable to said second portion;

an elongated and hollow shaft having a first end and a second end, said first end being attached to an outer surface of said first end wall and being fluidly coupled to said threaded depression, said shaft having plurality of openings therein positioned adjacent to said second end of said shaft, said openings being fluidly coupled to said threaded depression, a plurality of bristles being attached to said shaft and extending away therefrom, said bristles being disposed generally adjacent to said openings; and wherein the tube may be selectively fluidly coupled to said threaded depression such that pressure on the tube forces toothpaste therein through said shaft and outward through said openings.

* * * * *